US011448386B2

(12) United States Patent
Booth et al.

(10) Patent No.: US 11,448,386 B2
(45) Date of Patent: Sep. 20, 2022

(54) CONTROL MODULE OF OR FOR A LIGHT FITTING SYSTEM AND RELATED METHODS

(71) Applicant: ENERGY LIGHT GROUP LIMITED, Christchurch (NZ)

(72) Inventors: Ralph David Booth, Christchurch (NZ); Nelson Halwyn Duder, Christchurch (NZ)

(73) Assignee: ENERGY LIGHT GROUP LIMITED, Christchurch (NZ)

( * ) Notice: Subject to any disclaimer, the term of this patent is extended or adjusted under 35 U.S.C. 154(b) by 0 days.

(21) Appl. No.: 17/416,226

(22) PCT Filed: Dec. 20, 2019

(86) PCT No.: PCT/IB2019/061148
§ 371 (c)(1),
(2) Date: Jun. 18, 2021

(87) PCT Pub. No.: WO2020/128983
PCT Pub. Date: Jun. 25, 2020

(65) Prior Publication Data

US 2022/0074582 A1 Mar. 10, 2022

(30) Foreign Application Priority Data

Dec. 20, 2018 (NZ) ..... 749530

(51) Int. Cl.
*F21V 23/00* (2015.01)
*F21S 8/00* (2006.01)
(Continued)

(52) U.S. Cl.
CPC ..... *F21V 23/008* (2013.01); *F21S 8/038* (2013.01); *F21V 21/15* (2013.01); *F21V 21/29* (2013.01);
(Continued)

(58) Field of Classification Search
CPC ..... F21S 8/038; F21V 21/15; F21V 21/29
See application file for complete search history.

(56) References Cited

U.S. PATENT DOCUMENTS 5,072,216 A * 12/1991 Grange ..... H05B 39/00 315/293
6,079,862 A * 6/2000 Kawashima ..... G01S 3/7864 700/59
(Continued)

FOREIGN PATENT DOCUMENTS

EP 1483534 B1 6/2006

OTHER PUBLICATIONS

International Search Report and Written Opinion of International Searching Authority for International Application No. PCT/IB2019/061148.

*Primary Examiner* — Evan P Dzierzynski
(74) *Attorney, Agent, or Firm* — JCIP; Joseph G. Chu; Jeremy I. Maynard

(57) ABSTRACT

A light fitting control module able to receive a coupler of a light fitting that is also able connect to an electrically power track. The light fitting is able to be supported and/or powered by the track. The control module comprises a first coupler able to connect with the supporting power track and a second coupler able to connect to the coupler of said light fitting to support and electrically connect said light fitting with the electrically powered track. The control module is configured and adapted to respond to remote command to control at least one degree of freedom of operation the lighting fitting.

13 Claims, 7 Drawing Sheets

(51) Int. Cl.

| | |
|---|---|
| ***F21V 21/15*** | (2006.01) |
| ***F21V 21/29*** | (2006.01) |
| ***F21V 21/35*** | (2006.01) |
| ***F21V 23/06*** | (2006.01) |
| ***G08C 17/02*** | (2006.01) |
| ***H01R 33/90*** | (2006.01) |
| ***H01R 33/945*** | (2006.01) |
| *H01R 25/14* | (2006.01) |

(52) U.S. Cl.
CPC ..... *F21V 21/35* (2013.01); *F21V 23/06* (2013.01); *G08C 17/02* (2013.01); *H01R 33/90* (2013.01); *H01R 33/945* (2013.01); *H01R 25/142* (2013.01)

(56) References Cited

U.S. PATENT DOCUMENTS

| | | | | |
|---|---|---|---|---|
| 6,655,817 | B2 | 12/2003 | Devlin et al. | |
| 7,507,005 | B1 | 3/2009 | Mier-Langner | |
| 8,354,948 | B2 | 1/2013 | Priest | |
| 2005/0243549 | A1 | 11/2005 | Ruston | |
| 2007/0268701 | A1* | 11/2007 | Devlin | F21V 21/15 362/272 |
| 2013/0155672 | A1 | 6/2013 | Vo et al. | |
| 2014/0056010 | A1* | 2/2014 | Devlin | H05B 47/19 361/728 |
| 2014/0254162 | A1 | 9/2014 | Holland et al. | |
| 2015/0003099 | A1 | 1/2015 | Rasmussen et al. | |
| 2016/0377225 | A1* | 12/2016 | Leibowits | F16M 11/425 248/323 |

* cited by examiner

CONTROL MODULE OF OR FOR A LIGHT FITTING SYSTEM AND RELATED METHODS

FIELD OF THE INVENTION

The present invention relates to a control module of or for a light system and related methods.

BACKGROUND

Lighting in art galleries typically comprises of a plurality of light fittings that each carry a replaceable lamp or lamps to illuminate artwork from above. The light fittings may include a base that can be used for connecting the light fitting to a mounting track.

A mounting track may be secured to a wall or ceiling of a building and may carry a plurality of light fittings spaced apart from each other along the track. The track is preferably of a constant cross section along most of its length and the base of a light fitting can be releasably engaged thereto to be positioned anywhere along the length of the mounting track. Galleries often need to change the lighting configuration of gallery rooms and so a quick release and install connection system is desirable. Light fittings can then be easily and quickly added or removed from a room and the base and track systems used, facilitate this.

Such systems may go by the general name of track lighting. US patent U.S. Pat. No. 7,507,005 shows an example. For each such systems, each light fitting may have a base that is of the same shape to be able to connect with tracks of a matching cross-sectional profile. The track itself may carry busbars along its length and with which terminals of the base of a light fitting can connect. This allows for power to be supplied to the light fitting to illuminate its lamp, without needing to additionally connect a separate power plug. Upon connecting the base to a track, the electrical power connection is hence automatically established.

Light fittings may include a tilt mechanism dependent from the base. This mechanism allows the angular position of a light bulb of the fitting to be adjusted.

Light fittings may from time to time need to be adjusted so that light is projected in a different direction. This requires a person to manually manipulate the light fitting such as by moving the tilt mechanism of a light fitting. This is easy to do where the light fitting is able to be reached from ground level. But when light fittings are located up high adjustment may require the use of a ladder. This can be time consuming and potentially also dangerous.

There is hence a need to improve the convenience and reduce the danger of adjusting light fittings.

It is an object of the present invention to provide a control module of or for a light system and related methods which overcomes or at least partially ameliorates some of the abovementioned disadvantages or which at least provides the public with a useful choice.

BRIEF DESCRIPTION OF THE INVENTION

Accordingly in a first aspect the present invention may broadly be said to be a light fitting control module able to be interposed between an electrically powered track and a light fitting, carrying at least one electrically energisable lamp, that are able to be releasably and directly coupled together in a predetermined mode of coupling, the module configured and adapted to present the same said mode of coupling for its coupling to the electrically powered track and the light fitting interposed between said electrically powered track and light fitting, the control module able to be electrically powered by the electrically powered track and when powered and in use to respond to remote command to control at least one degree of freedom of operation of a light fitting when coupled to the control module.

In a second aspect the present invention may broadly be said to be a light fitting control module able to be interposed between (i) an electrically powered track and (ii) a light fitting that has at least one electrically energisable lamp, that are able to be releasably and directly coupled together in a predetermined mode of coupling, the module comprising a main body and a first coupler presented by said main body to releasably couple to the electrically powered track and a second coupler presented by said main body to releasably couple to a light fitting coupler of the light fitting, the main body comprising a position controllable gimbal defining at least one axis of rotation that allows the light fitting position to be controlled (a) by remote input relative to the electrically powered track when the control module is coupled to the electrically powered track and the light fitting (b) by a servo motor of the control module that is able to be electrically powered via the first coupler by the electrically powered track, where the control module is configured and adapted to present the same said mode of coupling for its coupling to the electrically powered track and the light fitting interposed between said electrically powered track and light fitting as the predetermined mode, and wherein the control module is able to establish an electrical connection between the light fitting and the electrically powered track to energise the at least one lamp of the light fitting.

Preferably the light fitting control module comprises a main body and a first coupler presented by said main body for releasably coupling to the electrically powered track and a second coupler presented by said main body to releasably couple to a light fitting coupler of the light fitting.

Preferably the light fitting control module comprises a main body and a first coupler presented by said main body for releasably coupling to the electrically powered track and a second coupler presented by said main body to releasably couple to a light fitting coupler of the light fitting, the main body comprising a position controllable gimbal defining at least one axis of rotation that allows the light fitting position to be controlled by remote input relative to the electrically powered track when the control module is coupled to the electrically powered track and the light fitting.

Preferably the main body comprises a controller able to receive said remote input and to control the position of the gimbal.

Preferably the light fitting control module comprising a main body and a first coupler presented by said main body for releasably coupling to the electrically powered track and a second coupler presented by said main body to releasably couple to a light fitting coupler of the light fitting, the main body comprises a controller able to receive remote input and to control the said at least one degree of freedom of the light fitting, said at least one degree of freedom selected from at least one of:

a. switching on of the light fitting's lamp or lamps individually and/or collectively,
b. switching off of the light fitting's lamp or lamps individually and/or collectively,
c. light spread control,
d. light colour control, and
e. light intensity.

Preferably the control module is adapted for;

(a) either direct power take-off from the electrically powered track or indirect power take-off and support from the electrically powered track, and/or (b) either direct or indirect support and a direct or indirect supply of power from the electrically powered track for said light fitting.

Preferably the control module is itself a modular assembly depending on desired capability.

Preferably the control module is directly mechanically and electrically engageable to the supporting electrically powered track.

Preferably the control module is directly mechanically and electrically able to be coupled to the electrically powered track.

Preferably the control module is directly mechanically and electrically able to be coupled with said light fitting.

Preferably the control module is directly mechanically and electrically able to be coupled with said light fitting and can transmit electrical power between the supporting electrically powered track and the light fitting.

Preferably the at least one degree of freedom is of an alignment axis of the light fitting relative to the electrically powered track.

Preferably the module can affect change in two degrees of freedom, preferably in a pan and tilt orientation of the light fitting relative to the track.

Preferably said at least one degree of freedom is selected from at least one of:

a. switching on of the light fitting's lamp or lamps individually and/or collectively, b. switching off of the light fitting's lamp or lamps individually and/or collectively, c. light spread control, d. light colour control, and e. light intensity.

In a further aspect the present invention may be said to be, in combination as an assembly, a control module as herein defined, a remote controller for the module, a said electrically powered track, and a said light fitting.

Preferably the light fitting can also be directly supported and powered from said electrically powered track and said control module embodies couplers that hitherto have allowed such support and power for the light fitting.

In yet a further aspect the present invention may be said to be a light fitting control module to:

(a) releasably interpose between an electrically powered track for light fittings and a light fitting comprising at least one light fitting coupling to mechanically and electrically capable of coupling selectively to each of (i) the electrically powered track and the control module, and (b) control by remote command at least one degree of freedom of operation of the light fitting;

wherein the control module in use is able to respond to said remote command to control at least one degree of freedom of movement to move the light fitting relative to the electrically powered track and/or at least one degree of freedom in electrical activation of at least one lamp of the light fitting relative to the electrical empowerment of the electrically powered track;

and wherein (A) the control module;

(i) itself is or is to be releasably engageable mechanically and electrically to the electrically powered track, or (ii)(a) itself is or is to be releasably engageable mechanically to the electrically powered track and (ii)(b) separately of any such type (ii)(a) mechanical engagement, itself, or the light fitting, is or is to be engageable electrically to the electrically powered track;

and wherein (B) the control module (i) itself is or is to be releasably engageable mechanically and electrically to the light fitting, or (ii) itself is or is to be mechanically engageable to the light fitting in the case of the second electrical engagement option of (A)(ii)(b).

In still a further aspect the present invention may be said to be a method of improving the functionality of a light fitting of or for an electrically powered track from which it is or it might be supported and powered, the method comprising or including interposing a control module between the track and the light fitting in such a way that the light fitting can be powered from the track via the control module, the control module being able to respond to a remote command to adjust at least one degree of freedom provisioned for or by the light fitting comprising of at least one of:

a. switching on of the light fitting's lamp or lamps individually and/or collectively, b. switching off of the light fitting's lamp or lamps individually and/or collectively, c. light spread control, d. light colour control, and e. light intensity.

Preferably the control module is a retrofit control module able to be incorporated into a lighting system that includes at least one electrically powered track and at least one light fitting.

In yet a further aspect the present invention may be said to be a retrofit remote control module able to receive a coupler of a light fitting comprising an electrically powered lamp and said coupler of said light fitting is able to also connect to a supporting track coupler of an electrically power track by which the light fitting, by the light fitting coupler, is able to be supported and/or powered, said control module comprising:

a first coupler able to connect with the supporting power track coupler, and a second coupler able to connect to the coupler of said light fitting to support and electrically connect said light fitting with the electrically powered track, wherein the module is configured and adapted to respond to remote command to control at least one degree of freedom of operation of a lighting fitting.

Preferably intermediate of the first and second coupling said module comprises a body that comprises of a remotely controllable gimbal that provides at least one degree of freedom of rotation of the light fitting relative to the track when connected to the track.

Preferably intermediate of the first and second coupler said module comprises of a remotely controllable light controller that provides at least one degree of freedom of control of the light to affect light fitting light emission characteristics selected from at least one of;

(a) light on, (b) light off, (c) light spread, (d) light colour, and (e) light intensity.

In still a further aspect the present invention may broadly be said to be a retrofit remote control module able, when powered and in use, to respond to remote command to control at least one degree of freedom of operation of a light fitting, the module being adapted for (a) either direct power take-off from a supporting powered track or indirect power take-off and support from such a supporting powered track, and/or (b) either direct or indirect support and a direct or indirect power supply for such a light fitting.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

BRIEF DESCRIPTION OF THE DRAWINGS

The invention will now be described by way of example only and with reference to the drawings in which.

DETAILED DESCRIPTION OF THE INVENTION

Figure 1:
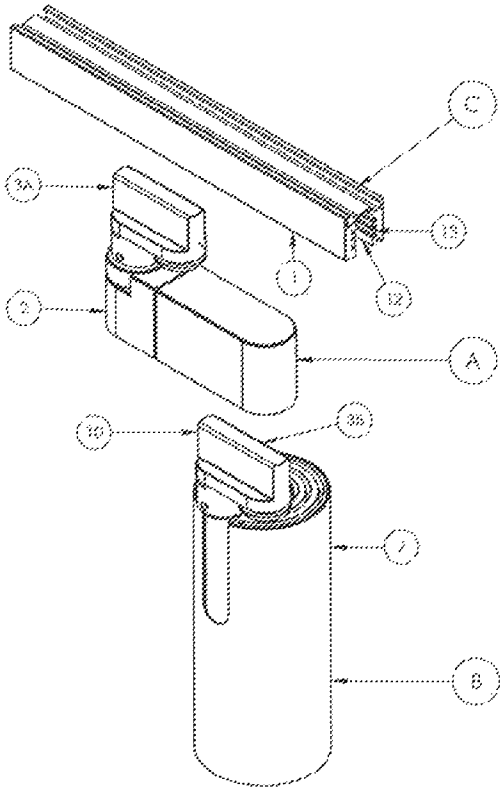
FIG. 1 shows an exploded view of one preferred form of a control module used for connecting a light fitting to a track, and a track and light fitting.
Figure 2:
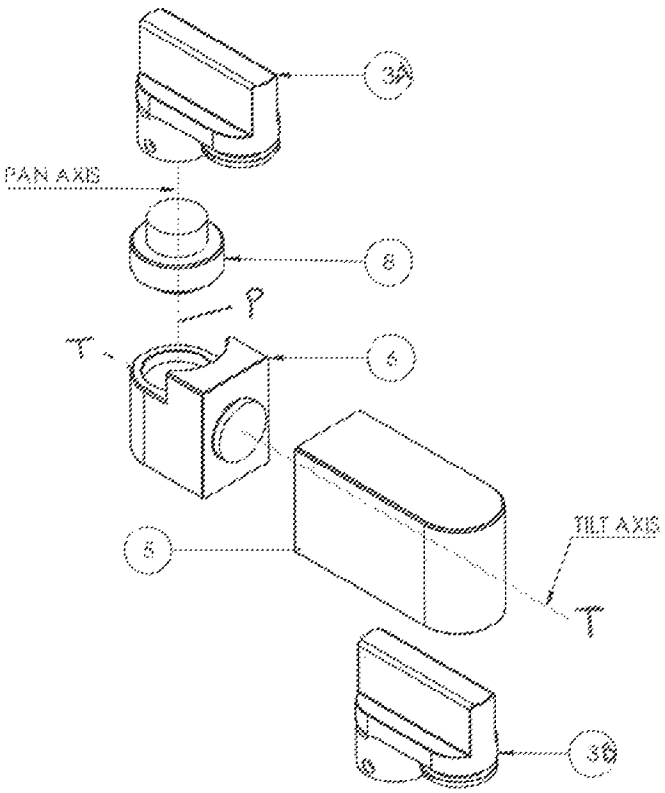
FIG. 2 shows an exploded view of a control module.
Figure 3:
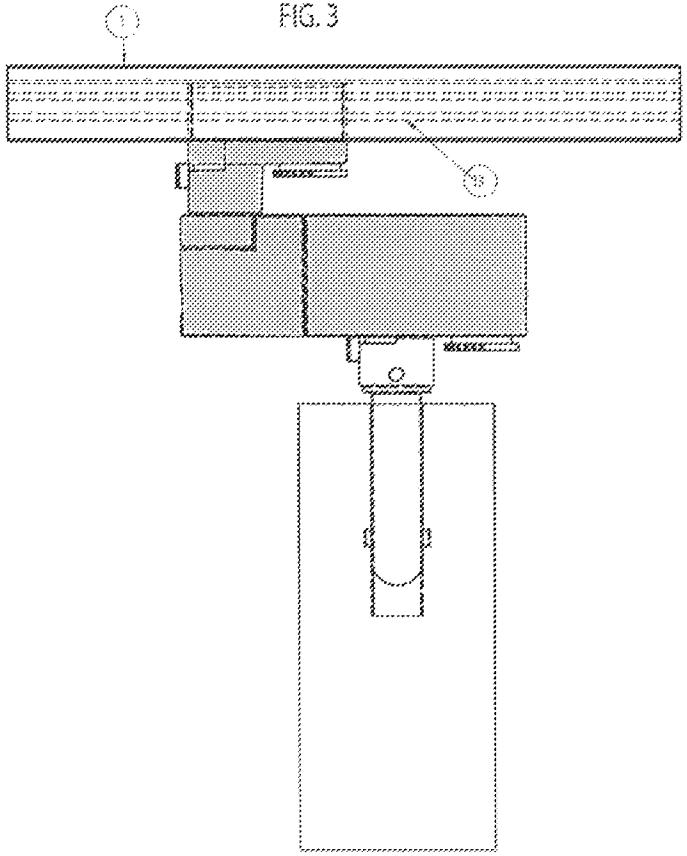
FIG. 3 shows an assembled view of FIG. 1 in side view.
Figure 4:
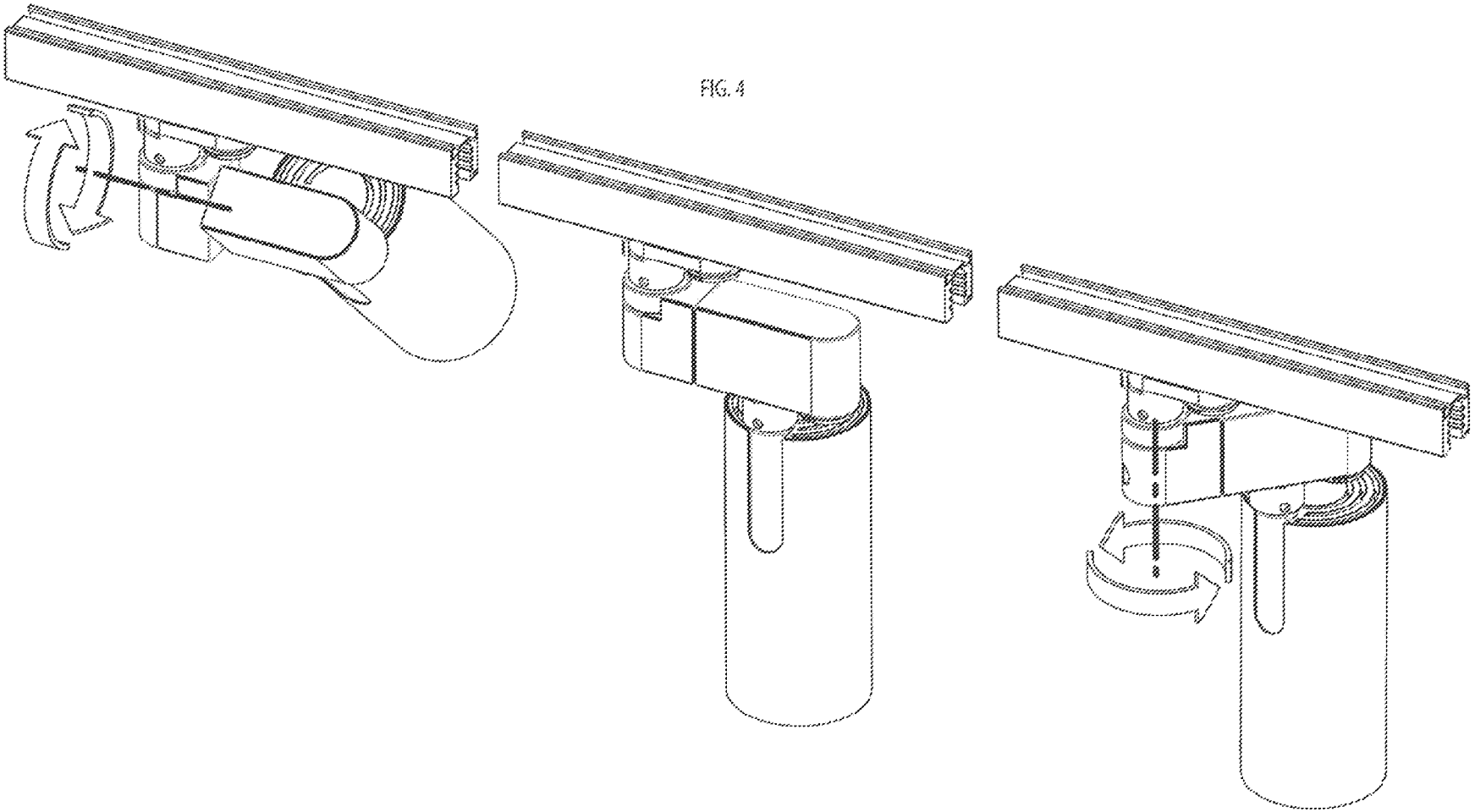
FIG. 4 shows how a light fitting may pan and tilt.
Figure 6:
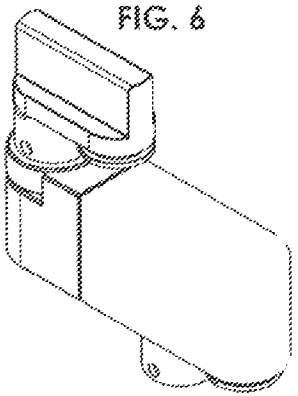
FIG. 6 shows a perspective view of a control module of figure of 5.
Figure 9:
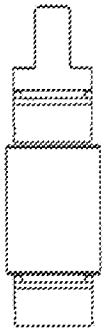
FIG. 9 is another end view of the control module of FIG. 5.
Figure 10:
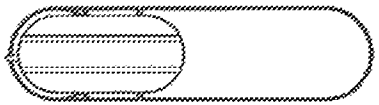
FIG. 10 is a plan view of a control module of FIG. 5.

In FIG. 1 there is shown a light fitting control module A with which a light fitting B is able to connect. The control module A is also able to connect to a supporting electrical power track C. When so connected the light fitting B is able to be fully supported by the track C, which itself is secured to a structure such as a wall or ceiling of a building.

In the example shown in FIG. 1, the control module A comprises of a main body 2 and a first coupler 3A and a second coupler 11 presented from or by the main body 2. The second coupler 11 is preferably of a female of socket configuration able to receive a light fitting coupler 3B which preferably presents as a male or plug configuration. The first coupler 3A is preferably of a male or plug configuration as seen in FIG. 1. The first coupler 3A and the light fitting connector 3B are preferably of a configuration both compatible for connecting to the track C. The track C preferably presents a track coupler 1 at which the first coupler 3A and also the light fitting coupler can couple. Preferably the light fitting coupler 3B and the first coupler 3A are preferably of the same configuration. The light fitting coupler 3B is dependent from a body 7 of the light fitting B The control module A facilitates the creation of a connection between the light fitting B and the control module A and between the track C and the control module A.

The light fitting coupler 3B includes a light fitting plug 10 that is able to be releasably coupled to a second coupler 11. The second coupler 11 can receive the light fitting coupler 3B is a secure manner to hold the light fitting B to the control module A.

The coupling of the light fitting B to the module A and/or the track C and the coupling of the module A with the track C may be a quick release format so that light fittings can be quickly interchanged with the control module A and/or the track C.

The light fitting coupler 3B may be releasably attached to the body 7 of the light fitting or may be permanently engaged with the body 7. The light fitting coupler 3B may be releasably attached to the body 7 of the light fitting or may be permanently engaged with the body 7 to present the light fitting coupler 3B for connection with the second coupler 11 and preferably also with the track C.

The light fitting coupler 3B is preferably of a shape and configuration to also be able to connect to the track C at the track coupler 1. This allows for the light fitting B to also be directly engaged to the track C. The light fitting coupler 3B is preferably of a shape that allows for the light fitting to mechanically couple directly to the supporting power track coupler 12 of the supporting power track 1 and also to the second module coupler 11. The light fitting coupler 10 is preferably also able to directly and indirectly electrically connect to the supporting power track 1.

The control module A may have several functions including the function of transferring power from the track C to the light fitting B preferably via the track coupler 1, the first coupler 3A, the second coupler 11, and the light fitting coupler 3B, to power at least one lamp 14 of the light fitting B.

The supporting power track C may include electrical contacts or terminals or busbars (hereinafter 'electrical terminals 13') in a channel 12 of the track C that, when aligned with corresponding electrical terminals of the light fitting coupler 3B are able to make an electrical connection for the supply of electrical power to a lamp 14 of the light fitting 7.

The supporting power track C may include electrical contacts or terminals or busbars (hereinafter 'electrical terminals') that, when aligned with corresponding electrical terminals of the first coupler 3A are able to make an electrical connection for the supply of electrical power the control module.

The light fitting coupler 3B (whether provided removable or integrally formed with or permanently attached to the body 7) is able to also make an electrical and a mechanical and releasable connection with the control module B at the second coupler 11.

Figure 5:
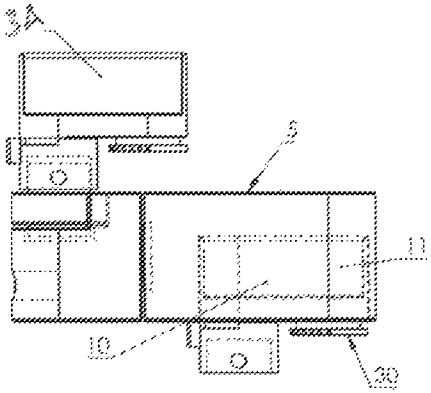
FIG. 5 shows a view of a control module with hidden detail shown.
Figure 8:
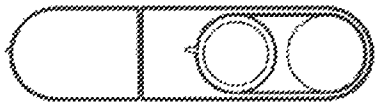
FIG. 8 is a bottom view of the control module of FIG. 5.
Figure 7:
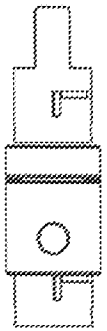
FIG. 7 is an end view of the control module of FIG. 5.

The control module B includes a second module coupler 11 which may for example comprise of a receptacle or socket in the body 2 of the module. The receptacle or socket can receive the light fitting coupler 3B into it as seen in FIG. 5. A mechanical fastening device 30 may be used for establishing a secure yet releasable connection of the light fitting coupler with the control module A. The mechanical fastener 30 may be a screw device that causes for a threaded engagement or an expanding snug fit or interference fit engagement to be established by the light fitting coupler 3B with the second coupler 11.

The second coupler 11, as well as providing releasable mechanical engagement with the light fitting coupler 3B, may also provide for an electrical connection between the control module A and the light fitting B. Electrical terminals may be provided within the receptacle or socket of the second coupler 11 with which electrical terminals of the light fitting coupler 3B can electrically connect and thereby allow for electrical power to be transferred to the light fitting B for the purposes of controlling and/or powering the lamp or lamps of the light fitting B.

The first coupler 3A is able to be utilised for connecting the control module A to the supporting electrical power track C. The format of connection of the first coupler 3A to the supporting electrical power track 1 is preferably the same as that of the light fitting coupler 3B to the second coupler 11. This allows for a releasable connection to be established to the supporting power track C for the control module A.

The first coupler 3A may be integrally formed or permanently connected to the main body 2 as part of the control module A or may be a separate component for releasable connection to the main body 2. Its form and function is preferably such as to be able to be received mechanically by the track coupler 2 in a releasable manner.

The first coupler 3A may also establish an electrical connection with the electrical terminals 13 of the track C. The first coupler 3A may include electrical contacts to establish an electrical connection with the electrical terminals 13 of the track C and allow for power to be transmitted between the control module A and the track C. The control module A may include electrical connections to transfer power from the supporting power track C via the control module 2 to the light fitting 7. Such power may also be drawn from for the purposes of control of the control module C.

The control module C may include electric and/or electronic components that may preform at least one function. The components are preferably contained in the main body 2 of the module C.

Control module A may function to cause a one axis rotation of the module relative the track C when connected to the track C. Such can allow the control and adjustment and readjustment of the orientation of the light fitting B relative to the track C. In the preferred form the control module A is configured to provide for a tilt axis TT to allow for the light fitting B to rotate about this axis TT. This allows for light from the light fitting to be projected in a new direction.

In a preferred form the control module A is also able to control and reposition the light fitting B by virtue of the control module establishing a controllable pan axis PP. The light fitting is able to be rotated about the axis PP. The control and repositioning is preferably provided by a position controllable gimbal 6 of the module A. The gimbal 6 may provide for the axis or axes of rotation, the rotation controlled for example by servo motors that are able to be controlled by remote control for rotation to adjust the pan and/or tilt axes positioning of the light fitting. The main body 2 may hence comprised of a gimbal 6 and a housing 5 able to couple to the body gimbal of the module A in a rotational manner so that the gimbal 6 and housing 5 are able to rotate relative to each other about the axis TT. The gimbal may also able to be rotationally coupled to the bearing 8 which is connected or connectable to the first connector 3A to allow for rotation about the axis PP. A servo motor or other types of position control motor can be used for each of the pan and/or tilt mechanisms and are preferably reliant on power provided via the track C. The control is preferably exercised by a controller such as a remote controller 16 that may rely on a wifi or RF or Bluetooth or other wireless transmitting protocol to communicate with a receiver R of the control module A. The receiver R of the module A is preferably coupled to an electronic controller of the control module A to control the servo motors and/or other control elements carried by the control module A for positional and/or other control of the light fitting. Alternatively or additionally, control may happen via the track C by way of electrical or electronic control signals transmitted to the module A. This may happen via the electrical connections are herein before described.

Control signal or signals, whether wirelessly or via the track, are able to be transferred by the control module A to the light fitting, should the light fitting be of a kind that has some functionality responsive to input control.

Figure 11:
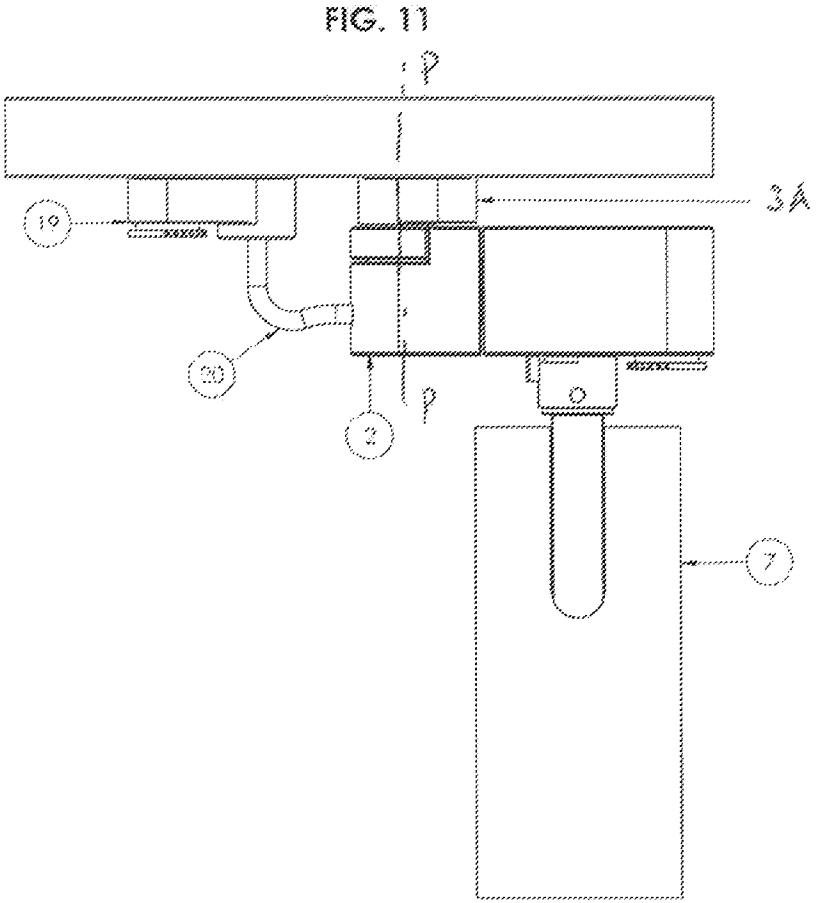
FIG. 11 is a front view of a control module wherein there is a separate power plug for engagement with the track.
Figure 12:
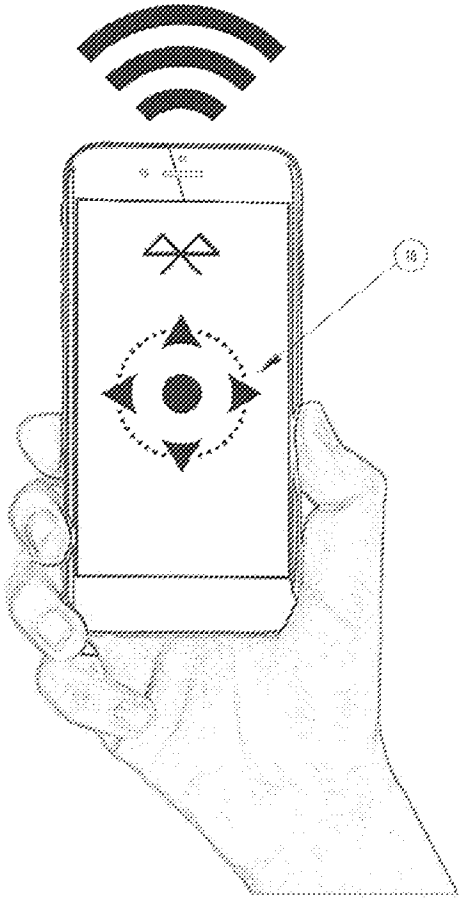
FIG. 12 is a view of a remote controller.

In an alternative form and as shown in FIG. 11 the electrical power connection for the light fitting B may pass via the control module A but not reliant on the first connector 3A but instead via an alternative connector 19 as seen in FIG. 11.

The alternative connector 19 may provide an electronical connection with the terminals 13 of the supporting power track C to transfer power via a cable 20 to the module A for transfer to the light fitting B. The alternative connection 19 need not be of a strong mechanical type to also support the weight of the light fitting and may merely be sufficiently strong for making an electrical connection. The first connector 3A, making a mechanical connection with the supporting power track, provides for mechanical connection of sufficient strength and support to hold the light fitting B.

The control module may, in addition or alternative to position control of the light fitting relative to the track, also control any one or more of the following degrees of freedom that may be provided for or be facilitated of supported by the light fitting:

1. switching on of the light fitting's lamp or lamps individually and/or collectively,
2. switching off of the light fitting's lamp or lamps individually and/or collectively,
3. light spread control,
4. light colour control, and
5. light intensity.

Light spread control may be achieved by control over individual lamps of a light fitting. Likewise light intensity control may be so achieved or by way of adjusting voltage supply to a lamp of lamps of the light fitting.

The invention claimed is:

1. A light fitting control module able to be interposed between (i) an electrically powered track and (ii) a light fitting that has at least one electrically energisable lamp, that are able to be releasably and directly coupled together in a predetermined mode of coupling, the control module comprising a main body and a first coupler presented by said main body to releasably couple to the electrically powered track and a second coupler presented by said main body to releasably couple to a light fitting coupler of the light fitting, the main body comprising a position controllable gimbal defining at least one axis of rotation that allows the light fitting position to be controlled (a) by remote input relative to the electrically powered track when the control module is coupled to the electrically powered track and the light fitting (b) by a servo motor of the control module that is able to be electrically powered via the first coupler by the electrically powered track, where the control module is configured and adapted to present the same said mode of coupling for its coupling to the electrically powered track and the light fitting when the control module is interposed between said electrically powered track and light fitting, as the predetermined mode, and wherein the control module is able to establish an electrical connection between the light fitting and the electrically powered track to energise the at least one lamp of the light fitting.

2. The light fitting control module as claimed in claim 1 wherein the main body comprises a controller able to receive said remote input and to control the position of the gimbal.

3. The light fitting control module as claimed in claim 1 wherein the light fitting control module comprising a main body and a first coupler presented by said main body for releasably coupling to the electrically powered track and a second coupler presented by said main body to releasably couple to a light fitting coupler of the light fitting, the main body comprises a controller able to receive remote input and to control at least one of the following:

a. switching on of the light fitting's lamp or lamps individually and/or collectively,
b. switching off of the light fitting's lamp or lamps individually and/or collectively,
c. light spread control,
d. light colour control, and
e. light intensity.

4. The light fitting control module as claimed in claim 1 wherein the control module is adapted for;

(a) either direct power take-off from the electrically powered track or indirect power take-off and support from the electrically powered track, and/or
(b) either direct or indirect support and a direct or indirect supply of power from the electrically powered track for said light fitting.

5. The light fitting control module as claimed in claim 1 wherein the control module is directly mechanically and electrically able to be coupled to the electrically powered track.

6. The light fitting control module as claimed in claim 1 wherein the control module is directly mechanically and electrically able to be coupled with said light fitting.

7. The light fitting control module as claimed in claim 1 wherein the control module is directly mechanically and electrically able to be coupled with said light fitting and can transmit electrical power between the supporting electrically powered track and the light fitting.

8. The light fitting control module as claimed in claim 1 wherein the at least one degree of freedom is of an alignment axis of the light fitting relative to the electrically powered track.

9. The light fitting control module as claimed in claim 1 where the main body comprises a controller able to receive remote input and to control at least one of:

a. switching on of the light fitting's lamp or lamps individually and/or collectively,
b. switching off of the light fitting's lamp or lamps individually and/or collectively,
c. light spread control,
d. light colour control, and
e. light intensity.

10. In combination as an assembly, a control module as claimed in claim 1, a remote controller for the module, a said electrically powered track, and a said light fitting.

11. A method of improving the functionality of a light fitting of or for an electrically powered track from which it is or it might be supported and powered, the method comprising or including interposing a control module of claim 1 between the track and the light fitting in such a way that the light fitting can be powered from the track via the control module, the control module being able to respond to a remote command to adjust at least one degree of freedom provisioned for or by the light fitting comprising of at least one of:

a. switching on of the light fitting's lamp or lamps individually and/or collectively,
b. switching off of the light fitting's lamp or lamps individually and/or collectively,
c. light spread control,
d. light colour control, and
e. light intensity.

12. A light fitting control module to:

(a) releasably interpose between an electrically powered track for light fittings and a light fitting comprising at least one light fitting coupler mechanically and electrically capable of coupling selectively to each of (i) the electrically powered track and the control module, and
(b) control by remote command at least one degree of freedom of operation of the light fitting;

wherein the control module in use is able to respond to said remote command to control at least one degree of freedom of movement to move the light fitting relative to the electrically powered track with a gimbal and a servo motor of the control module, the control module comprising a main body and a first coupler and a second coupler that are presented by said main body, wherein (A) the control module:
(i) itself is or is to be releasably engageable mechanically and electrically to the electrically powered track using the first coupler, or
(ii)(a) itself is or is to be releasably engageable mechanically to the electrically powered track using the first coupler and (ii)(b) separately of any such type (ii)(a) mechanical engagement, itself, or the light fitting, is or is to be engageable electrically to the electrically powered track;

and wherein (B) the control module:
(i) itself is or is to be releasably engageable mechanically and electrically to the light fitting using the second coupler and the light fitting coupler wherein a format of connection of the first coupler to the electrical power track is same as the format of connection of the light fitting coupler to the second coupler.

13. A method of improving the functionality of a light fitting of or for an electrically powered track from which it is or it might be supported and powered, the method comprising or including interposing a control module of claim 12 between the track and the light fitting in such a way that the light fitting can be powered from the track via the control module, the control module being able to respond to a remote command to adjust at least one degree of freedom provisioned for or by the light fitting comprising of at least one of:

a. switching on of the light fitting's lamp or lamps individually and/or collectively,
b. switching off of the light fitting's lamp or lamps individually and/or collectively, c. light spread control,
d. light colour control, and
e. light intensity.

* * * * *